US006958954B2

(12) United States Patent
Haeni et al.

(10) Patent No.: US 6,958,954 B2
(45) Date of Patent: Oct. 25, 2005

(54) DEVICE INDICATING THE STATE OF BATTERIES DESIGNED TO EQUIP A WATCH

(75) Inventors: Urs Haeni, Studen (CH); Laurent Boillod, Morteau (FR)

(73) Assignee: ISA France S.A., Villers-le-Lac (CH)

( * ) Notice: Subject to any disclaimer, the term of this patent is extended or adjusted under 35 U.S.C. 154(b) by 144 days.

(21) Appl. No.: 10/398,155

(22) PCT Filed: Oct. 19, 2001

(86) PCT No.: PCT/IB01/01960

§ 371 (c)(1),
(2), (4) Date: Apr. 1, 2003

(87) PCT Pub. No.: WO02/35296

PCT Pub. Date: May 2, 2002

(65) Prior Publication Data

US 2004/0041570 A1 Mar. 4, 2004

(30) Foreign Application Priority Data

Oct. 24, 2000 (FR) ..... 00 13621

(51) Int. Cl.[7] ..... G04B 9/00
(52) U.S. Cl. ..... 368/66; 368/203; 368/204; 368/61
(58) Field of Search ..... 368/64, 66, 203, 368/204

(56) References Cited

U.S. PATENT DOCUMENTS 3,823,551 A * 7/1974 Riehl ..... 368/66
4,058,969 A * 11/1977 Tamaru et al. ..... 368/249
4,290,129 A * 9/1981 Ushikoshi ..... 368/66
4,690,568 A * 9/1987 Odagiri et al. ..... 368/204
5,446,702 A 8/1995 Mossuz et al. ..... 368/37
5,691,078 A 11/1997 Kozaki et al. ..... 429/92
6,320,822 B1 * 11/2001 Okeya et al. ..... 368/66

FOREIGN PATENT DOCUMENTS

| | | | |
|---|---|---|---|
| CH | 684623 | 11/1994 | ..... G04C/10/04 |
| EP | 0 713 101 | 5/1996 | ..... G01R/31/36 |
| JP | 58-061488 | 4/1983 | ..... G04C/10/00 |
| WO | WO 99/05538 | 2/1999 | ..... G01R/31/36 |

* cited by examiner

*Primary Examiner*—Andrew H. Hirshfeld
*Assistant Examiner*—Andrea H. Evans
(74) *Attorney, Agent, or Firm*—Browning Bushman; Hugh R. Kress

(57) ABSTRACT

The invention concerns a device for indicating the state of watch batteries. Said device comprises, in combination: a circuit for determining (34) at least a physical characteristic of the cell (10) which varies when it is nearly discharged, a circuit for metering (36) the power consumed by the watch, a circuit for assessing (40) the capacity rating of the battery, connected to the determining (34) and metering (36) circuits and designed to process data and select the most relevant information derived either from the determining circuit (34), or from the metering circuit (36), means for displaying the state of the battery (38,40,42), and a circuit controlling (39) the display means.

8 Claims, 1 Drawing Sheet

DEVICE INDICATING THE STATE OF BATTERIES DESIGNED TO EQUIP A WATCH

FIELD OF THE INVENTION

The invention concerns a device indicating the state of batteries, designed to equip a watch. Such devices are well known to those skilled in the art.

BACKGROUND OF THE INVENTION

One of them is described in U.S. Pat. No. 5,446,702. It comprises, in a watch, an electronic circuit for assessing the charge of its battery, a device for displaying the date and an independent motor to drive this display device. When the charge falls below a limit value, the electronic circuit gives the order to the motor to drive the display device to a position indicating that the battery is nearly discharged. The information thus given is therefore of the binary type. The person wearing the watch thus has a few days to change its battery.

Another device of this type is described in document JP 58061488. This concerns more specifically a watch including means for converting the battery charge into an operating time. This watch comprises a counter and a display. The counter is regularly incremented and its content, which corresponds to the remaining lifetime, is indicated by means of the display. The wearer thus knows the battery's life expectancy at any time. For such a device to be reliable, a large safety margin must be adopted. This is because the capacity of a battery cannot be measured precisely without discharging it. This capacity varies considerably from one battery to another, notably due to storage conditions. Accordingly, there is no doubt that, in many cases, the battery will be changed when its power reserve could still ensure operation for several weeks, or even several months. If the safety margin is inadequate, it is likewise possible that the reserve may be smaller than that assessed, so that the watch stops before the indicator is at zero, which is even more troublesome.

SUMMARY OF THE INVENTION

The aim of the present invention is to overcome these drawbacks. This aim is achieved due to the act that the device according to the invention comprises, in combination:

- a determining circuit for determining at least one physical characteristic of the battery, which varies when it is nearly discharged;
- a counting circuit for counting the power consumed by said watch;
- an assessing circuit for assessing the capacity of the battery, connected to the determining and counting circuits and designed to process data derived from the determining circuit, the counting circuit, or a combination thereof;
- means for displaying the state of the battery, said means consisting of a hand and a scale against which said hand moves, said scale comprising a first sector which indicates the quantity of power available in a range between 100% and a non-null value, and a second sector, which indicates that the battery is nearly discharged, and
- a controlling circuit for controlling the display means, said controlling circuit being designed so that it brings the hand opposite the first sector exclusively so long as the physical characteristic is greater than a limit value.

While the simplest watches comprise merely a motor driving all their moving parts, others, more complex, comprise additional transducers, like an electro-acoustic transducer, activated to indicate, by emitting a sound, a pre-determined time. Such transducers considerably influence the watch's power consumption. That is why, in a very interesting embodiment in which the device is designed to equip a watch which comprises several electrical components of which at least one serves to activate an additional function at the request of the user, the counting circuit includes a memory in which is stored information relating to this component's power consumption. The counting circuit is designed to send to the assessing circuit data relating to the power consumed, whenever the additional function, activated on demand, is utilised.

It is generally advantageous for the assessing circuit to be designed so that it sends to the controlling circuit the information derived from the counting circuit so long as the information derived from the determining circuit indicates normal operation of the battery. This is because, in most cases, the information derived from the determining circuit varies only when the available power can ensure a few more days' normal operation. By proceeding in this way, the watch indicates, during most of the operating lifetime of its battery, information derived from the counting circuit which is given based on the consumption of the various components, whereas when the battery it is nearly discharged, it is the determining circuit that takes over, so that the information displayed is based on information relating to the state of the battery.

In a preferred embodiment, the displaying means comprise a hand. Moreover, the controlling circuit is designed so that, for a given power consumption, the hand's movement increases as the available power decreases. In this way, the reading can be taken over a large angle when the battery is nearly discharged, which is the most critical period.

Preferably, the displaying means comprise, in addition, a scale against which the hand moves. This scale comprises a first sector indicating the available power, ranging between 100% and a non-null value, and a second sector indicating that the battery is nearly discharged. The controlling circuit is designed so that it moves the hand opposite the first sector exclusively so long as the information derived from the counting circuit is considered the most relevant. The controlling circuit is designed so that the hand is moved opposite the second sector when the assessing circuit sends to the controlling circuit an order indicating that the battery is nearly discharged, as soon as the information derived from the determining circuit shows that the physical characteristic of the battery is varying.

BRIEF DESCRIPTION OF THE DRAWINGS

Other advantages and characteristics of the invention will become clear from the following description, made with reference to the annexed drawings, on which.

DETAILED DESCRIPTION OF PREFERRED EMBODIMENTS

Figure 1:
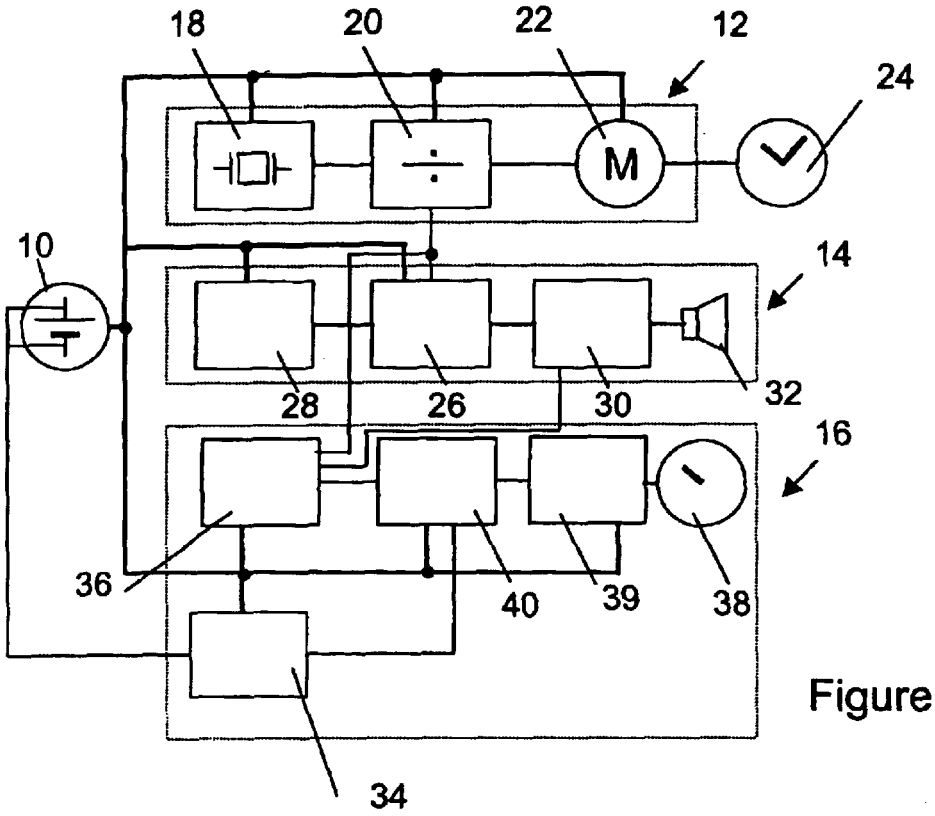
FIG. 1 represents schematically a watch provided with such a device.

The watch schematically represented in FIG. 1 comprises, conventionally, a battery 10, an electronic time counting circuit 12, an electronic alarm circuit 14 and a device for detecting and indicating the state of the battery 16. The battery 10 powers circuits 12 and 14 and the device 16, as represented on the drawing by the thick lines.

The time counting circuit 12 consists of a time base 18, generally a quartz crystal and its control circuit, a frequency divider 20 also performing a counter function, and an electromagnetic transducer 22, formed of a motor and its control circuit.

The time base 18 delivers a sinusoidal signal of stable frequency. The divider 20 converts the sinusoidal signal into square pulses and divides the frequency to 1 Hz or less, depending on the motor's frequency of rotation. The divider 20 also performs a counter function. It is designed to contain information relating to the second, minute and hour of the current time. The 1 Hz signals are applied to the control circuit of the motor, which delivers drive pulses. The motor of the transducer 22 comprises a rotor, driven by these drive pulses, which sets in rotation a gear train, schematically represented in 24, carrying the hands that provide a display of the current time.

The alarm circuit 14 is formed of a comparator 26, a memory 28, a control 30 and an electro-acoustic transducer 32. It is designed to draw the attention of the wearer at a given time, chosen beforehand. The comparator 26 is connected to the dividing circuit 20, to the memory 28 and to the control 30. When the contents of the memory 28 and of the counter part of divider 20 are identical, this means that the chosen time is reached. The comparator 26 gives this information to the control 30 which then activates the transducer 32.

The device for detecting and indicating the state of the battery 16 comprises a circuit 34 for determining the state of the battery charge, a circuit 36 for counting the power consumed by the watch components, display means 38, a circuit 39 controlling the display means, and an assessing circuit 40.

The circuit 34 determines whether the voltage measured on load is or is not less than a limit value which, when it is reached, means that the battery is nearly discharged. It is connected to the terminals of the battery 10 or of a resistance mounted in series at its output, to measure the voltage, in conventional manner.

The counting circuit 36 is connected to the divider 20 and the control 30. It thus knows the time during which the transducer 32 operates and the number of times that the alarm is activated. Note that it is not necessary for the counting circuit 36 to be connected to the transducer 22, because the latter operates in a regular manner, so that its consumption can be assessed on the basis of information derived from the divider 20.

It is quite clear that if the watch was provided with other functions, e.g. a chronograph, the counting circuit 36 would also be connected to the circuit controlling that function, so as to know the time during which it operates.

The counting circuit 36 comprises a memory and a decrementing counter, which have not been represented in the drawing to avoid cluttering it. The memory contains information relating to the foreseeable capacity of the battery and the power consumption of each of the watch components, which will be specified further on. This information is introduced in the factory.

Figure 2:
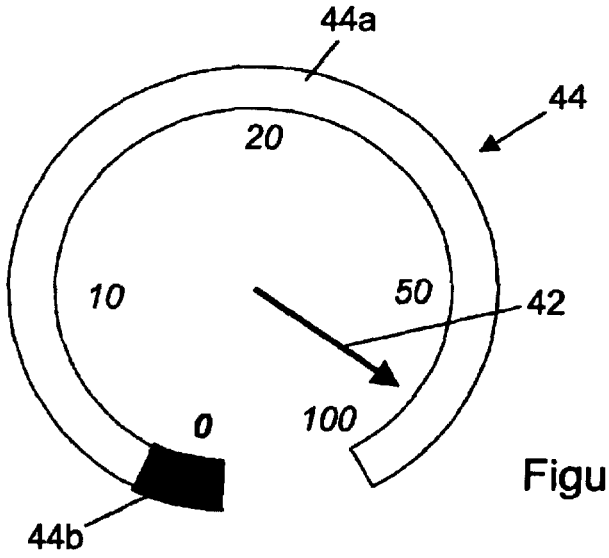
FIG. 2 shows part of the watch dial with the means for displaying the state of the battery.

The display means 38 are partly represented in FIG. 2. There one can see a hand 42 and a display scale 44 comprising a first sector 44*a* opposite which are indications relating to the charge, in this case the numbers "100, 50, 20 and 10", and a second sector 44*b* opposite which the hand 42 is placed when the battery is nearly discharged.

The hand 42 is carried by a wheel forming part of a gear train, itself driven by a stepping motor. Neither the motor nor the gear train has been represented in the drawing to avoid cluttering it.

The assessing circuit 40 receives information from both the determining circuit 34 and the counting circuit 36.

The watch as defined above comprises, moreover, controlling means making it possible to correct the time displayed and enter the times at which the alarm is to be activated, which have not been represented, because they are well known to those skilled in the art. It operates as follows.

The time base 18 delivers an input signal to the divider 20. The latter sends pulses to the motor 22 which drives the gear train 24. The divider 20, in its counter part, contains information relating to the current time, i.e. the minute, hour, day, etc.

The controlling means of the watch consist, for example, of a crown wheel or push-buttons, allowing to modify the information displayed by the hands by causing the motor 22 to operate at high speed and, simultaneously, to correct the content of the divider 20.

The controlling means perform, moreover, the modification and activation or deactivation of the alarm circuit 14. More precisely, the content of the memory 28 can be adjusted, to thus record an alarm time. Moreover, the comparator 26 is operated in such a way that the control 30 is activated when the content of the memory 28 corresponds to the content of the counting part of the divider 20. The transducer 32 then emits one or more audible alarms informing the wearer, as programmed by him (her).

The counting circuit 36 has, in its memory, information relating to the capacity of the battery and the power consumption of the various watch components, as well as the indication of the battery charge. More precisely, the memory contains a value $C_p$ corresponding to the battery charge and two other values $T_m$ and $T_a$, relating to the watch's power consumption. $T_m$ refers to the watch's power consumption in normal operation, i.e. that relating to circuit 12, and $T_a$ to operation of that alarm, i.e. to circuit 14.

For example, with a battery capacity equal to 10 mAh, $C_p$ could be equal to 10,000. $T_m$ and $T_a$ are, then, the time duration necessary for the watch in normal operation and the alarm respectively, to consume 1 $\mu$Ah, i.e. one ten-thousandth of the total charge. Typically, $T_m$ could be equal to 3 600 seconds, i.e. one hour. This means that the watch's power consumption is 1 $\mu$A. $T_a$ could be equal to 3.6 seconds, the power consumption of the transducer 32 being equal to 1 mA. The information concerning the indication relating to the battery charge concerns the values of the state of the for which the hand should be moved. These values are called skip values in the remainder of the description.

When a new battery is installed, the decrementer is initialised at its nominal value. It is decremented by 1 whenever the watch in normal operation has fulfilled its function during a time $T_m$, or when the additional function is activated during a time $T_a$. The state of the decrementer is then compared with the value stored in memory relating to the indication. Whenever the state corresponds to a skip value, the information is transmitted to the assessing circuit 40.

The assessing circuit 40 receives information from both the determining circuit 34 and the counting circuit 36. So long as the determining circuit 34 informs the assessing circuit 40 that the battery voltage is greater than the limit value, the assessing circuit 40 considers the information derived from the counting circuit 36 relevant. It therefore gives the order to the indicator 38, and especially its motor, to drive the hand 42 by one step whenever the content of the counting circuit 36 is equal to a threshold value. The number of skip values, typically between 5 and 25, is equal to the number of steps that have to be executed by the motor of the indicator 38 for the hand 42 to pass through the angle corresponding to the sector 44*a*.

When the hand 42 has reached a position corresponding to the end of the sector 44*a*, this means that, for a normal battery, its life expectancy is low, approximately a few days to a few weeks. Below this value, there are no more skip values.

The hand 42 enters the second sector 44*b* only when the determining circuit 34 sends to the assessing circuit 26 the information relating to the voltage drop across the terminals of the battery 10. At that time, whatever the position of the hand 42, the latter is brought opposite sector 44*b*.

With such a mode of operation, it is possible that the hand 42 may never reach the boundary of the first sector or, on the contrary, may remain there for a relatively long time. A suitable choice of the value $C_p$ will be able to prevent the skip from being too great at the time when the determining circuit 34 informs the assessing circuit 40 that the battery is nearly discharged. In this way, the user may allow for this battery's end of life, changing it when he (she) has to leave on a trip, for example, whereas he (she) can wait for the hand to reach the sector 44*b* in normal conditions of life.

In the above description, various electronic circuits performing specific functions are mentioned. Needless to say that these functions could be performed by a microprocessor containing a program whose various sequences would perform the functions mentioned above.

The device as described can, of course, accept numerous variants. For example, it is possible to provide for a counting circuit 36 with an incrementer rather than a decrementer. It is also possible to provide for a linear scale for displaying the available power.

An equivalent solution can be applied to a watch provided with a liquid crystal display, of digital type or by sectors. One could also consider associating with the watch an additional indication when the battery is nearly discharged, e.g. by causing a seconds-hand to limp, by causing a display to flash, etc. It is also possible to interrupt the possible use of certain functions that are heavy power consumers, such as a chronograph, for example.

What is claimed is:

1. A device for indicating the state of a watch battery, characterised in that it comprises, in combination:

a determining circuit (34) for determining at least one physical characteristic of the battery (10) which varies when it is nearly discharged;

a counting circuit (36) for counting the power consumed by said watch;

an assessing circuit (40) for assessing the capacity of the battery, connected to the determining circuit (34) and the counting circuit (36) and designed to process data derived from the determining circuit (34), the counting circuit (36), or a combination thereof;

means for displaying the state of the battery, said means consisting of a hand (42) and a scale (44) against which said hand (42) moves, said scale comprising a first sector (44*a*) which indicates the quantity of power available in a range between 100% and a non-null value, and a second sector (44*b*), which indicates that the battery is nearly discharged, and a controlling circuit (39) for controlling said display means, said controlling circuit (39) being designed so that it brings the hand (42) opposite the first sector (44*a*) exclusively so long as the physical characteristic is greater than a limit value.

2. The device according to claim 1, incorporated in a watch, the watch comprising at least one electrical component (14) for activating at least one additional watch function at the request of the user, characterised in that said counting circuit (36) comprises a memory in which is stored information relating to the power consumption of said electrical component, and is designed so as to send to the assessing circuit (40) information relating to the power consumed whenever the additional watch function, activated on demand, is utilised.

3. The device according to one of claims 1, characterised in that said assessing circuit (40) is designed so as to send to said controlling circuit (39) information derived from the counting circuit (36) so long as the information derived from the determining circuit (34) indicates the quantity of power available is in a range between 100% and a non-null value.

4. The device according to claim 3, characterised in that said assessing (40) and controlling (39) circuits are designed so that, for a given power consumption, the movement of the hand increases as the available power decreases.

5. The device according to claim 1, characterised in that the controlling circuit (39) is designed so that said hand (42) is brought opposite the second sector (44*b*) when said assessing circuit (40) sends to the control circuit (39) an order indicating that the battery is nearly discharged, as soon as the information derived from the determining circuit (34) shows that said physical characteristic is varying.

6. The device according to claim 2, characterised in that said assessing circuit (40) is designed so as to send to said controlling circuit (39) information derived from the counting circuit (36) so long as the information derived from the determining circuit (34) indicates the quantity of power available is in a range between 100% and a non-null value.

7. The device according to claim 6, characterised in that said assessing (40) and controlling (39) circuits are designed so that, for a given power consumption, the movement of the hand increases as the available power decreases.

8. The device according to claim 6, characterised in that the controlling circuit (39) is designed so that said hand (42) is brought opposite the second sector (44*b*) when said assessing circuit (40) sends to the control circuit (39) an order indicating that the battery is nearly discharged, as soon as the information derived from the determining circuit (34) shows that said physical characteristic is varying.

* * * * *